United States Patent [19]

Martini

[11] 4,365,812

[45] Dec. 28, 1982

[54] GAME BOARD AND APPARATUS

[76] Inventor: Leonard J. Martini, 2801 Ocean Front Walk, F, San Diego, Calif. 92109

[21] Appl. No.: 244,125

[22] Filed: Jun. 1, 1981

[51] Int. Cl.[3] ..... A63F 3/00; A63F 9/04

[52] U.S. Cl. ..... 273/243; 273/146

[58] Field of Search ..... 273/243, 248, 146

[56] References Cited

U.S. PATENT DOCUMENTS

| | | | |
|---|---|---|---|
| 1,480,360 | 1/1924 | Agee, Jr. | 273/146 UX |
| 2,343,812 | 3/1944 | Sikora | 273/248 |
| 2,557,583 | 6/1951 | Vitale | 273/248 |
| 3,649,022 | 3/1972 | Clarke, Jr. | 273/248 X |
| 4,119,321 | 10/1978 | Creel | 273/248 |
| 4,123,062 | 10/1978 | Wexler et al. | 273/248 |

OTHER PUBLICATIONS

R. C. Bell, *Board and Table Games from Many Civilizations,* Pub. 1960 Oxford Univ. Press pp. 10, 25, 20, 53, XXI, XXII.

*Primary Examiner*—Vance Y. Hum
*Assistant Examiner*—Scott L. Brown

[57] ABSTRACT

Game apparatus including a game board having an arrangement of parallel columns of which each column contains a number of holes for the emplacement of two groups of markers that are moved according to the roll of dice comprised of marked sticks.

1 Claim, 3 Drawing Figures

GAME BOARD AND APPARATUS

BACKGROUND OF THE INVENTION

This invention relates to board games in which markers are moved and positioned according to the roll of stick dice on a game board consisting of an arrangement of columns which are segmented to allow movement of the markers along the length and across the columns.

OBJECTS AND SUMMARY OF THE INVENTION (a) It is an object of the present invention to provide a game apparatus wherein opposing players move markers along the length of parallel columns and across columns, from one column to an adjacent column.

(b) It is an additional object of this invention to provide a game board comprised of parallel columns, segmented into a number of spaces equivalent to the number of parallel columns such that each space shall accommodate one marker.

(c) It is a further object of the present invention to provide an apparatus adopted for determining the number and direction of moves for the markers along the length and across the columns of the game board.

(d) It is yet another object of this invention to provided a chance apparatus adopted for competitive movement of markers along the length and across adjacent columns wherein an object of the game procedure is to block the advancement of opposing markers while controlling columns of section of columns for the purpose of advancing your own markers to the opposite end of the gameboard such that they may be removed before your opponent removes his markers from the opposite end of the game board in like manner. The first player to remove all of his markers from the game board is the winner.

Other objects and features of this invention will be obvious to a person skilled in the art from the detailed discription taken with the accompanying drawings, in which.

DETAILED DESCRIPTION OF THE INVENTION

Figure 1:
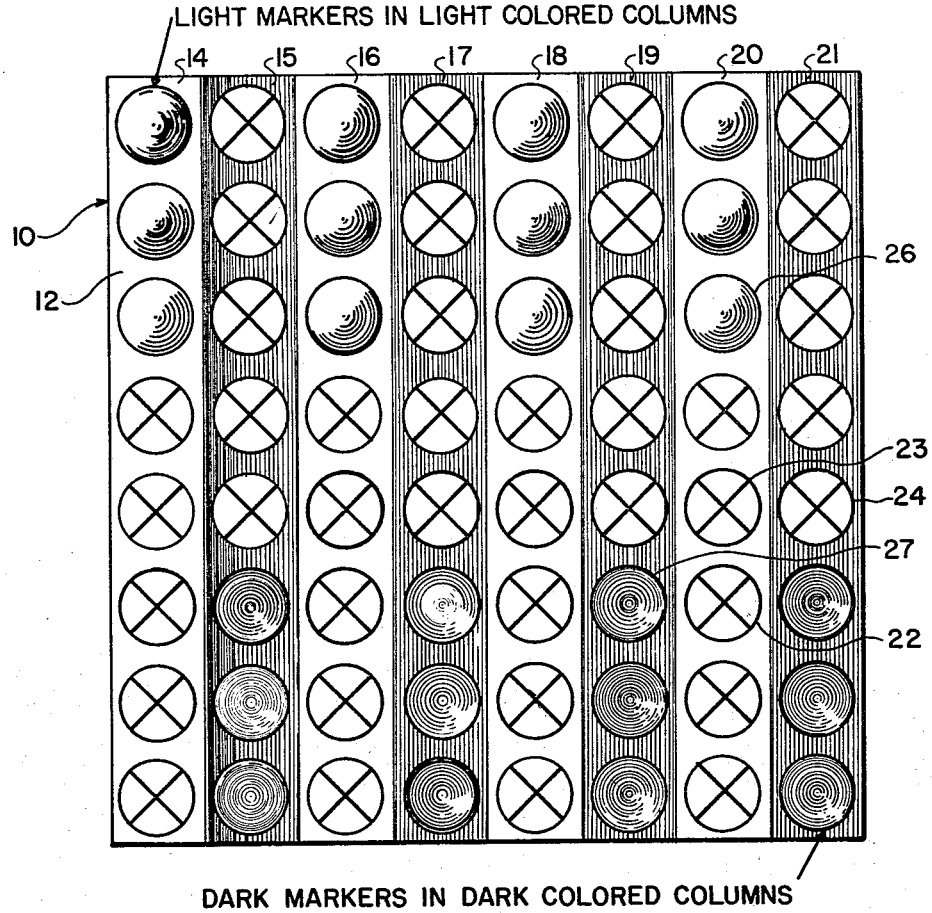
FIG. 1 shows a top view of one embodiment of the game board with designated opposing markers located in their starting positions.
Figure 2:
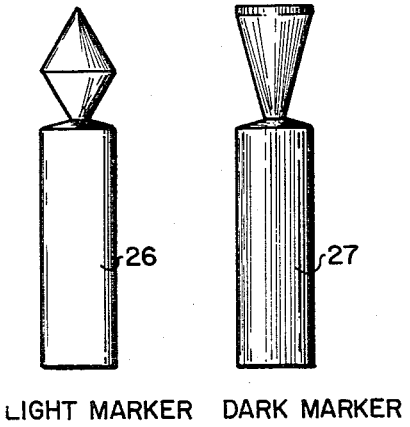
FIG. 2 shows the typical shape of light and dark colored markers.

Referring now to one embodiment of the subject game board as illustrated in FIG. 1, the game board 10 comprises a flat surface 12 onto which eight columns are specified by contrasting colors, light columns 14, 16, 18, and 20 alternating with dark columns 15, 17, 19 and 21. Each of these eight columns is segmented into eight spaces by incorporation of a circular hole, typically denoted by 22, 23 and 24. The 64 circular holes in the game board are sized to accept and support the light and dark colored markers in a vertical position. The light colored markers are typically designated as 26 while the dark markers are typically designated as 27. In addition to color distinction, the light and dark colored markers are typically shaped as shown in FIG. 2.

Figure 3:
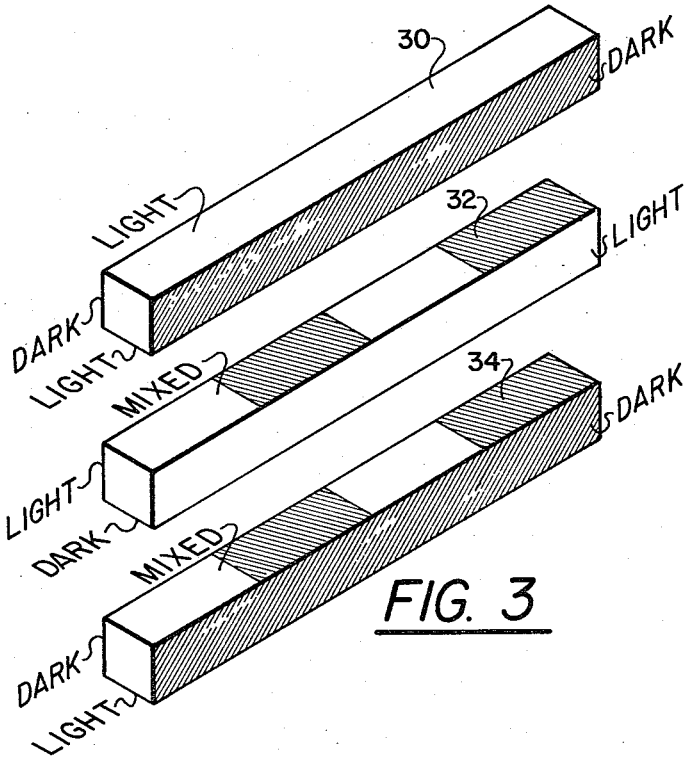
FIG. 3 shows a perspective end view of the three stick dice with the various side designations (colors or marks) which determine the movement of markers upon the game board.

The movement of the markers on the game board is determined by the roll of the three stick dice illustrated in FIG. 3. Each of the three stick dice has four sides colored to match either the light color markers, the dark color markers, or a mixture of the two light and dark colors. All four sides of each stick are of equal size such that an end view forms a perfect square and each side of each stick has an equal chance of being rolled in the up or showing position.

Each of the stick dice is marked (painted) differently: stick die 30 having alternating colored sides; stick die 32 having one mixed color side, an opposing dark colored side, and two light colored sides; and stick die 34 having one mixed color side, an opposing light colored side, and two dark colored sides. The three stick dice are used by rolling them between the palms of the hands and throwing them down.

Under a preferred game procedure, twelve light colored markers and twelve dark colored markers are moved upon the game board according to the roll of the stick dice. The playing board is set up for play, as shown in FIG. 1, by placing three markers in the first three holes of each of the four columns corresponding to the color of the markers; light colored markers 26 in light colored columns 14, 16, 18 and 20, opposing dark colored markers 27 in dark colored columns 15, 17, 19 and 21. The player to roll the greatest number of his color is the first to begin the game. For example, if the "light" player rolls two lights and the "dark" player rolls only one dark, than the light player begins the game first. The mixed color sides of the stick dice do not count while determining who will start the game.

Markers 26 and 27 are moved according to the number of light or dark colored sides showing on the rolled stick dice. Whenever a mixed color side is rolled, the player must move across into the next column, either light or dark column. For example, if the dark player rolls two mixed colored sides and one dark colored side, then dark marker 27 can be moved across into hole 22, forward into hole 23 and then across into hole 24, or marker 27 can be moved across into hole 22, and then any other dark marker or dark markers can be moved forward and/or across. If marker 27 is moved to hole 22, then the light marker 26 is blocked from moving beyond two moves forward. When to block and when to advance constitutes the skill in playing the game. Markers are moved according to the colors showing on the stick dice:

| COLORS ROLLED | MOVES |
|---|---|
| One of your color | 1 move forward |
| Two of your color | 4 moves forward |
| Three of your color | 9 moves forward |
| Mixed colors | Cross over into next column |

Any number of moves may be divided between any number of markers. For example, if you have light color markers and you roll two lights and one mixed color, then you can move one marker a total of 4 moves or two markers 2 moves or one marker 1 move and three markers 1 move, and any one of those markers or any other of your markers into the next column. In the preferred game procedure, markers may be moved either forward or across in any column, but never moved backward. If at any time in the game all your markers are blocked and you can not move, you then lose your turn until your opponent moves out of your way. The game is over when either all the light or dark colored markers have been removed from the playing board, or if neither player can possibly move. The player to first remove all his markers from the game board is the winner.

Variations of the preferred game procedure may include one or more of the following rules:

1. Markers may be moved forward in only columns of corresponding color; light markers in light columns, dark markers in dark columns.
2. Markers may be moved backward in only columns of corresponding color.
3. Markers may be moved backward in only columns of opposite color; light markers in dark columns, dark markers in light columns.
4. Markers may be moved backward in columns of either color.

While I have herein shown an described the preferred apparatus and method for playing the game of the present invention and have suggested certain variations thereof, other changes and modifications within the scope of the present invention are also contemplated. Accordingly, the above description should be construed as illustrative, and not in the limiting sense, the scope of the invention being defined by the following claims.

What is claimed is:

1. A game apparatus comprising:

a. game board means having a plurality of columns adjacently aligned and each column segmented by a plurality of holes and each column being distinguishable from adjacent columns by markings, b. a plurality of marker means adapted for emplacement in the said holes of the columns and said marker means being grouped by markings; and c. chance means for initiating and directing the movement of said marker means between said holes within and across said columns, and said chance means including plurality of indicia corresponding to the markings of the said columns and said markers, wherein said chance means is comprised of three sticks each having four sides distinguished by either of the two colors or markings of the said columns and said markers, or a mixture of the two colors or markings of the said columns and said markers, wherein: The first stick has distinguishable sides alternating between the two colors or distinguishable markings of the said columns and markers, the second stick has one side distinguishable by a mixture of the two colors or distinguishable markings of the said columns and markers, the opposite side distinguishable by the lighter of the two colors or distinguishable markings of the said columns and markers, and the remaining two sides distinguishable by the darker of the colors or distinguishable markings of the said columns and markers; and the third stick has one side distinguishable by a mixture of the two colors or distinguishable markings of the said columns and markers, the opposite side distinguishable by the darker of the two colors or distinguishable markings of the said columns and markers, and the remaining two sides distinguishable by the lighter of the two colors or distinguishable markings of the said columns and markers.

* * * * *